US006371774B2

(12) United States Patent
Royer

(10) Patent No.: US 6,371,774 B2
(45) Date of Patent: Apr. 16, 2002

(54) TAP CONNECTOR

(75) Inventor: Laurent Christian Royer, Courlon (FR)

(73) Assignee: Tyco Electronics Simel S.A., Gevrey-Chambertin (FR)

( * ) Notice: Subject to any disclaimer, the term of this patent is extended or adjusted under 35 U.S.C. 154(b) by 0 days.

(21) Appl. No.: 09/760,092

(22) Filed: Jan. 12, 2001

(30) Foreign Application Priority Data

Jan. 12, 2000 (EP) ..... 00400063

(51) Int. Cl.[7] ..... H01R 13/648
(52) U.S. Cl. ..... 439/100; 439/207
(58) Field of Search ..... 439/100, 799, 439/800, 803, 806, 816, 835, 836, 112, 121, 122, 214, 212, 207, 208

(56) References Cited

U.S. PATENT DOCUMENTS

| | | | | | |
|---|---|---|---|---|---|
| 1,422,374 | A | * | 7/1922 | Rambo | 439/208 |
| 1,486,560 | A | * | 3/1924 | Becker | 439/100 |
| 2,077,613 | A | * | 4/1937 | Bondeson | 439/100 |
| 2,547,932 | A | * | 4/1951 | Downs, Jr. | 439/100 |
| 3,052,748 | A | * | 9/1962 | Curtiss | 174/51 |
| 3,058,087 | A | * | 10/1962 | Piasicki | 439/100 |
| 3,982,319 | A | * | 9/1976 | Bice | 29/868 |
| 5,306,170 | A | * | 4/1994 | Luu | 439/100 |

* cited by examiner

*Primary Examiner*—Gary Paumen
*Assistant Examiner*—Ross Gushi

(57) ABSTRACT

An electrical tap connector having first and second housings fitted about a conductor and held together by clips to establish contact pressure between a conductive strap and the conductor.

5 Claims, 2 Drawing Sheets

TAP CONNECTOR

BACKGROUND OF THE INVENTION

The present invention relates generally to electrical tap connectors and in particular to those used in medium and high voltage applications within electrical transport networks and high voltage substations.

DESCRIPTION OF THE PRIOR ART

In such applications, it is common to use substantial rigid or semi-rigid conductors of, for example, aluminum or copper alloys. These conductors could take on the form of a solid or a tubular cross-section. The present invention may also be adapted to form an interconnection with multi-strand insulated cable if so desired. At present, it is known to form connections with these types of conductors through a device that utilizes a main body having a half-circular profile which generally corresponds to that of the conductor and acts as a base cradle for an engaging element. The engaging element includes at least one bolt acting transversely to the conductor and co-operating with tightening elements that are thereby brought into contact with the conductor. The electricity from the conductor is then tapped off through a flange incorporated in the base. An example of this type is disclosed in EP-A-0 599 754.

The aforementioned system has two main disadvantages. First, the quality of the electrical contacting and the mechanical tightening strength are directly linked to the length of the connector and the number of screws and associated clamps incorporated therein. Directly related to this is the time and associated cost necessary to engage the clamps in a connector of this type. Second, the main body of a connector of this type must perform two functions. The first function is electric and therefore must incorporate conductive materials such as aluminum or copper alloys. The second function is mechanical in that the body is an integral part of the mechanical engagement of the conductor. In order to satisfy both of these requirements, the body of a connector of this type is typically a substantial element.

SUMMARY OF THE INVENTION

It is an object of the present invention to provide an electrical tap connector which provides for a new tightening apparatus and separates the electrical and mechanical functions of the connector.

The objects of the present invention are accomplished by providing an electrical connector for a longitudinally extending conductor, comprising:

- a first housing having a shell-like body with an inner profile to receive the conductor therein and extending partially around the conductor to side edges where at least one side edge has first ears therealong, the body further having oppositely disposed recesses extending from the side edges;
- a second housing having a shell-like body with an inner profile to receive the conductor therein and extending partially around the conductor to side edges positioned proximate the side edges of the first housing and having second ears along at least the one side edge that corresponds to the side edge of the first housing having the first ears thereupon;
- a conductor strap to be positioned transversely between the conductor and the first housing with contact surfaces extending out of the recesses of the first housing; and

- a clip insertable upon the ears of the first housing and the second housing to hold the housings together and the conductive strap in engagement with the conductor.

It is an advantage of the present invention that the number of elements of the connector have been reduced and application of the connector to a conductor has been simplified through the use of the clip.

It is another advantage of the present invention that by separating the electrical component, the conductive strap, from the mechanical components, the first housing and the second housing, it is possible to optimize the material for the particular function and application. In particular, it is possible to select the material for the conductive strap that corresponds directly to that of the conductor. For example, if the conductor is an aluminum alloy, the conductive strap may also be formed of an aluminum alloy or if the conductor is copper, the conductive strap may also be formed of copper. Additionally, the first and second housings may be formed of a material having a high mechanical strength without the need to consider electrical conductivity.

DETAILED DESCRIPTION OF THE PREFERRED EMBODIMENT

Figure 1:
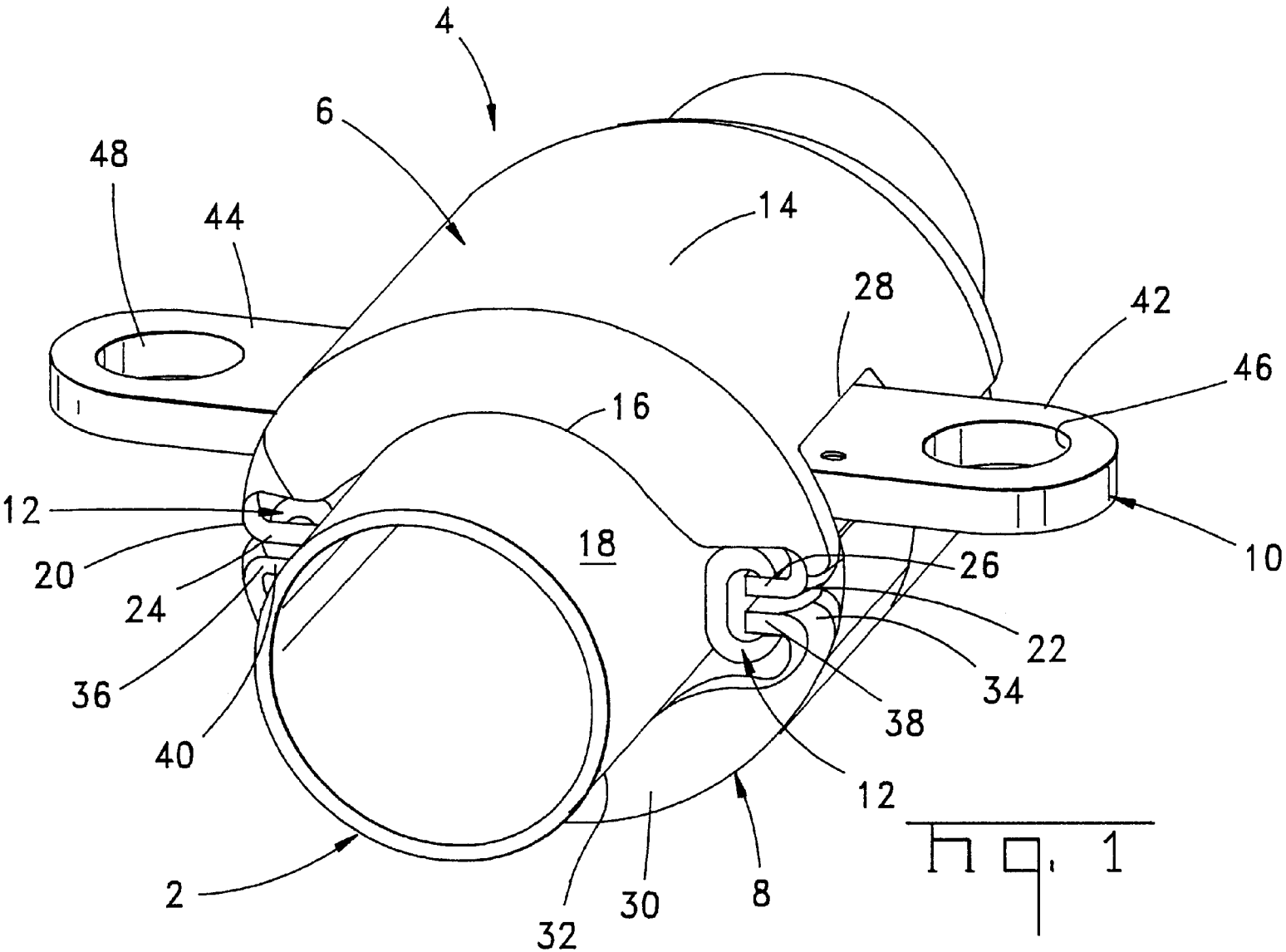
FIG. 1 is a perspective view of the connector according to the present invention disposed along a longitudinally extending conductor.

With reference now to FIG. 1, an electrical connector 4 according to the present invention is shown disposed upon a conductor 2. The conductor 2 is represented as a tubular element which would typically be constructed from an aluminum or copper alloy. The conductor 2 will be longitudinally extending and therefore it is necessary to have a connector 4 that may be fitted about the conductor 2 without the need for access to an end of the conductor 2. The connector 4 includes a first housing 6 that has a shell-like body 14 with an inner profile 16 configured to correspond generally to the outer surface 18 of the conductor 2. The first housing further includes side edges 20, 22 with first ears 24, 26 being formed to extend towards the conductor 2. It may also be possible to form these ears 24, 26 to extend outwards from the conductor 2. Additionally, the first housing 6 includes a recess 28 extending into the body 6 from the side edge 22.

The connector 4 further includes a second housing 8 also having a shell-like body 30 with an inner profile 32 also adapted to receive the conductor 2 therein. The body 30 of the second housing 8 further includes side edges 34, 36 with ears 38, 40 that are positioned proximate the ears 24, 26 of the first housing 6. It is important to note that while the embodiment described shows ears 24, 26 and 38, 40 disposed along both of the side edges 20, 22 and 34, 36 of the first housing 6 and the second housing 8, it is also possible that one of these side edge constructions be replaced with a hinge or some other interlocking configuration.

Figure 2:
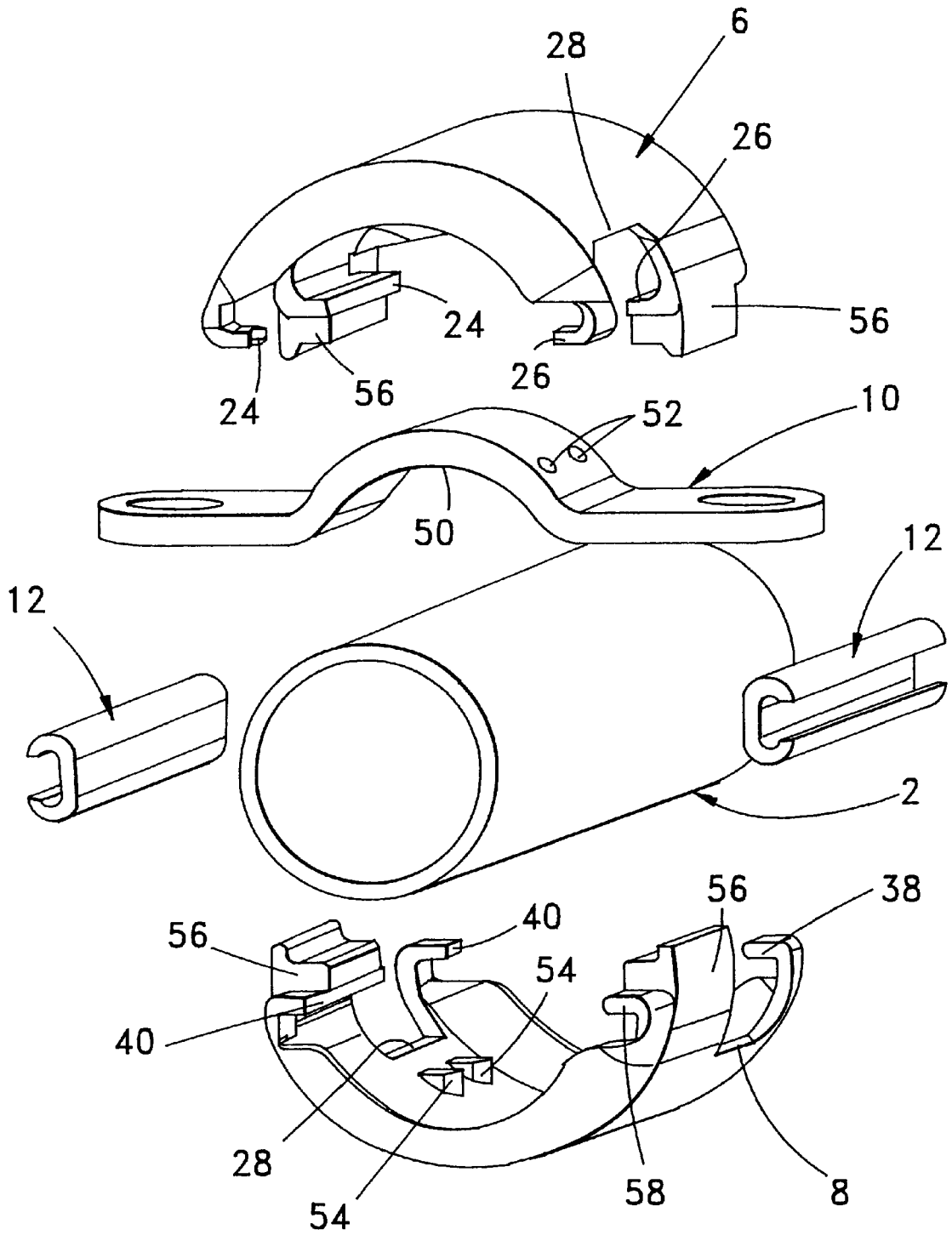
FIG. 2 is an exploded perspective view of FIG. 1.

A conductive strap 10, best seen in FIG. 2, is positioned within the first housing 6 such that the conductive strap 10 is disposed transversely to the conductor 2. The conductive strap 10 includes contact surfaces 42, 44 that are extending out of respective recesses 28. The contact surfaces 42, 44 are shown in the present embodiment including holes 46, 48 for termination to another electrical device or cable through mechanical means such as a nut and bolt or through welding. It is envisioned that other configurations for the contact surfaces 42, 44 may be advantageously utilized.

The first housing 6 and the second housing 8 are held together by clips 12. The clips 12 are configured as a C-shaped member that extend longitudinally along the conductor 2. The C-shaped member 12 is constructed to engage the ears 26, 38 of the first housing 6 and the second housing 8. Through this engagement, the first housing 6 and the second housing 8 are held together and the conductive strap 10 is held in engagement with the conductor 2.

With respect now to FIG. 2, the elements of the invention will be described in greater detail. An additional advantageous aspect of the embodiment shown is that the first housing 6 and the second housing 8 are provided with a hermaphroditic configuration and are therefore identically formed so that the number of differently manufactured elements for a connector 4 according to the present invention is reduced to 3. In addition, it may also be possible to incorporate a second conductive strap 10 if so desired.

With reference further to the conductive strap 10, this element is formed with an inner profile 50 that corresponds generally to that of the conductor 2. It is important to note that the sizes of the conductor 2 are standardized so that it is possible to produce electrical connectors 4 according to the present invention that are complementary to a given conductor 2. While the exemplary embodiment of the present invention is shown as a connector 4 for engaging a tubular conductor 2, it would also be possible for a connector according to the present invention to be adapted for either solid conductors 2 or multi-stranded cables. In the case of multi-stranded cable conductors, the present invention may also be adapted to engage cables that are covered with insulation by incorporating insulation piercing features along the inner profile 50. These insulation piercing features are well known in the art. The conductive strap 10 further includes pressure ledges 52 which are engaged by elements 54 of the respective housing 6, 8, as described below, in order to hold the conductive strap 10 against the conductor 2. As can be imagined, these pressure ledges 52 are disposed on both sides of the strap 10 so that for ledges 52 are formed by such processes as stamping.

With reference now to the housings 6, 8, the side edges 20, 22 and 34, 36 include positioning elements 56 that are received within recesses 28 of the corresponding housing for positioning the housings relative one another and for maintaining this positioning as the clip 12 is inserted upon the ears 24, 26 and 38, 40 which are separated by two portions via the recesses 28. As the first and second housing are of shell-like configuration, the interior surface thereof is formed with pressure transfer elements 54 which engage the pressure ledges 52 in order to transfer the mechanical forces established by joining the first housing 6 and the second housing 8 together through to the conductive strap 10.

In order to establish the contact pressure, the first housing 6 and the second housing 8 are joined together by clips 12. The clips 12 are C-shaped members where the clips are ultimately disposed within the electrical connector. This provides additional security features for the connector. However, as stated above, it is also possible that they can be disposed on the outer sides. While the dimensions of the conductor 2 are standardized, thereby making it possible for the designer to establish with fair reliability the dimensions needed for configuring the elements of the connector 4 such that the proper contact pressure is established, it may also be advantageous to establish a wedge-like locking between the housings 6, 8 and the clips 12 such that progressive tightening may be established. This can be done either by varying the sizes of the ears 24, 26 and 38, 40 or by adjusting the shape of the clips 12. Another alternative is to use a shape memory alloy for the clip wherein the temperature elevation caused by the current circulating through the conductor 2 will effect the tightening necessary to maintain proper electrical contacting of the strap 10 with the conductor 2. However, at present it is envisioned that the connector would be designed in such a way that the clips would fit upon the housing 6, 8 in such a way that application of the clips 12 establishes the necessary contact pressure. In contrast to the existing connectors wherein it is necessary to tighten bolts and have the associated tools to do so, the present invention envisions the simple use of an air hammer to drive the clips into place.

Therefore, the present invention has the advantageous features of providing for a simple tap connection to be made with a longitudinal extending component through a minimum number of components wherein the electrical and mechanical aspects have been separated such that the component performing these features may be optimized for their particular tasks and the device may be easily applied in the field.

I claim:

1. An electrical connector for a longitudinally extending conductor, comprising:

a first housing having a shell-like body with an inner profile to receive the conductor therein and extending partially around the conductor to side edges where at least one side edge has first ears therealong, the body further having oppositely disposed recesses extending from the side edges;

a second housing having a shell-like body with an inner profile to receive the conductor therein and extending partially around the conductor to side edges positioned proximate the side edges of the first housing and having second ears along at least the one side edge that corresponds to the side edge of the first housing having the first ears thereupon;

a conductor strap to be positioned transversely between the conductor and the first housing with contact surfaces extending out of the recesses of the first housing; and a clip insertable upon the ears of the first housing and the second housing to hold the housings together and the conductive strap in engagement with the conductor.

2. The electrical tap connector of claim 1 wherein the clip has a C-shaped profile.

3. The electrical tap connector of claim 1 wherein the first housing includes pressure transfer elements along an inner surface and the conductive strap includes pressure transferring ledges such that the contact pressure is established by engagement of these elements.

4. The electrical tap connector of claim 1 wherein the first housing and the second housing are hermaphroditic.

5. The electrical tap connector of claim 4 wherein the side edges of each housing include positioning segments that fit within the recess of the opposing housing.

* * * * *